United States Patent [19]

Anno et al.

[11] Patent Number: 4,978,595

[45] Date of Patent: Dec. 18, 1990

[54] PHOTOCONDUCTIVE TONER CONTAINING POLYMERIC-MAGNETIC COORDINATION COMPLEX

[75] Inventors: Masahiro Anno; Junji Machida; Junji Ohtani; Eiichi Sano; Fumio Masuda, all of Osaka, Japan

[73] Assignee: Minolta Camera Kabushiki Kaisha, Osaka, Japan

[21] Appl. No.: 420,724

[22] Filed: Oct. 11, 1989

Related U.S. Application Data

[63] Continuation of Ser. No. 278,748, Dec. 2, 1988, abandoned.

[30] Foreign Application Priority Data

Dec. 3, 1987 [JP] Japan ..... 62-308007

[51] Int. Cl.[5] ..... G03G 9/08

[52] U.S. Cl. ..... 430/106.6; 430/110; 430/138; 430/901

[58] Field of Search ..... 430/106.6, 110, 901, 430/138

[56] References Cited

U.S. PATENT DOCUMENTS

| | | | |
|---|---|---|---|
| 3,982,938 | 9/1976 | Honjo et al. | 430/901 X |
| 4,621,039 | 11/1986 | Ciccanelli et al. | 430/110 X |
| 4,623,606 | 11/1986 | Ciccanelli | 430/110 |
| 4,861,693 | 8/1989 | Ohtani et al. | 430/106.6 |

FOREIGN PATENT DOCUMENTS 60-107038 6/1985 Japan .

*Primary Examiner*—Roland Martin

*Attorney, Agent, or Firm*—Burns, Doane, Swecker & Mathis

[57] ABSTRACT

According to the present invention, the incorporation of polymeric-magnetic coordination complex powder in a photoconductive toner effects the production of toners excellent in dispersibility, heat stability, toner film formability and color reproducibility.

4 Claims, 4 Drawing Sheets

PHOTOCONDUCTIVE TONER CONTAINING POLYMERIC-MAGNETIC COORDINATION COMPLEX

This is a continuation of Ser. No. 278,748, filed Dec. 2, 1988, now abandoned.

BACKGROUND OF THE INVENTION

The present invention relates to a toner used for electrophotographic reproduction.

Image formation by electrophotography is widely known. In the general method, photosensitive member is entirely charged by corona discharge, then an electrostatic latent image is created by illumination of the image. In this case, exposed portion of the photosensitive member may become conductive, losing charge, and unexposed portion remains as an electrostatic latent image. When toner having reversed polarity is brought close to the electrostatic latent image, the toner is electrostatically attracted and the latent image is made visible and developed. Such image is usually transferred to paper in xerography or directly fixed on a photosensitive member in electrofax process.

The conventional image formation processes above mentioned involves complicated steps and requires a complex and expensive electrophotographic copying machine. Further, since the copy system comprises independent members, that is, a photosensitive member and toner powder, i.e., developer, deterioration of either of the above two members, for example, fatigue of the photosensitive member by illumination or deterioration of charge properties of the developer, results in difficulty in obtaining high definition copy. Therefore, the desired properties of the photosensitive member and the developer should be always maintained. Thus, troublesome maintenance of system is required.

Recently, a duplication process, wherein a photosensitive member is substituted by a photoconductive toner which is obtained by imparting photoconductivity to a developer, has been proposed to solve the foregoing problems.

Since the duplication process using photoconductive toner is a process wherein formation ability of electrostatic latent image is imparted to toner itself and a photosensitive member is not required, electrophotographic copying machine may be simplified, which advantageously results in decreased cost of product. Moreover, in this process, full-color image may be produced by one-shot.

Development of the photoconductive toner comprises formation of thin layer of toner onto a conductive substrate, followed by electrification, exposure, image transfer and fixing (see, for example, U.S. Pat. No. 2,758,939).

In development step of the photoconductive toner, it is required to form the thinnest, most uniform and largest-area toner layer on the photoconductive substrate from the viewpoint of enhancement of photosensitivity. The photoconductive toner hardly possesses practical photosensitivity partly because it is extremely difficult to satisfy such requirement. It is partly attributable to the problems such as ununiform triboelectrification and dusting of toner. Such deficient charge and dusting result in disarrangement or fog in duplicated image to deteriorate the picture qualities.

To solve above problems, magnetic material is proposed to be incorporated in toner (see, Japanese Patent Laid Open Publication No. 177157/1982 etc.).

However, all magnetic materials proposed in the above disclosure are inorganic and accompanied with problems of compatibility and dispersibility in resin. However, all magnetic materials proposed in the above disclosure are inorganic. The use of inorganic magnetic powder is accompanied with significant adverse effect. That is, inorganic magnetic powder itself does not have transparency. Further, it is difficult to uniformly disperse and incorporate inorganic magnetic powder in resin, resulting in muddiness as well as marked deterioration of transparency. Therefore, insufficient transparency of toner inevitably causes deterioration of photosensitivity. There is also a problem of muddiness in color images, so transparency of toner is insufficient and deterioration of photosensitivity is inevitable. There is also a problem of muddiness in color images.

SUMMARY OF THE INVENTION

It is difficult to form the photoconductive toner in an uniform, large-area thin layer mainly because effective technique is not applied, for example, to obtain uniform charge and prevent dusting of toner. Accordingly, as described above, poor photosensitivity and deterioration of picture qualities may be caused.

Considering such problems, the present invention is aimed at providing photoconductive toner which facilitates formation of uniform thin layer of toner required to obtain uniform charge, avoid dusting and improve photosensitivity of toner, and which possesses sufficient function required for toner powder layer.

DETAILED DESCRIPTION OF THE INVENTION

When the polymeric-magnetic coordination complex powder is incorporated in photoconductive toner, magnetic photoconductive toner which has good photosensitivity, excellent dispersibility, heat stability, ability to form thin toner layer, and good color reproducibility may be obtained.

Such toner comprises at least polymeric-magnetic coordination complex, colorant and binding resin.

Polymeric-magnetic coordination complex in the invention is a polymeric coordination complexes having ferromagnetic properties.

As the polymeric-magnetic coordination complex, for example, known materials such as poly-bis-(2,6-pyridinediylmethylidene nitrilohexamethylene nitrilomethylidene) iron sulfate (hereinafter referred to as "PPH.$FeS_4$"), polycarbene and the like can be used. Particularly, PPH.$FeSO_4$ is preferred.

PPH.$FeSO_4$ may be easily obtained by dehydration condensation of 2,6-pyridinecarbaldehyde and 1,6-hexanediamine, and reacting with $FeSO_4.7H_2O$ (see, for example, F. Lions and K. V. Martine: J. Am. Chem. Soc., 79, 2733 (1957) or T. Sugano, M. Kinoshita, I. Shirotani and K. Ohno: Solid State Comm., 45, 99 (1983) and the like). As the magnetic properties of such polymeric-magnetic coordination complex, i.e., PPH.$FeSO_4$, is as follows: (applied magnetic field: 1,000 Oe) magnetic flux density (Bm) about 42 G, magnetization ($\sigma$): about 3.5 emu/g, residual magnetization: about 7.1 G.

The invention can provide toners without the flying problem because toners can have small magnetism, and they are excellent in fixing properties because such hard components without thermo-melting as inorganic magnetic particles are not contained.

Figure 1:
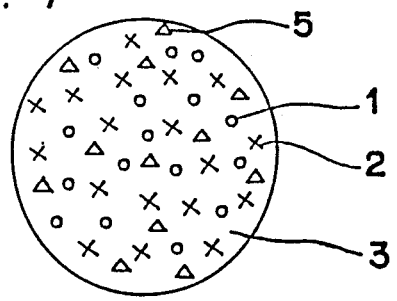
FIGS. 1–12 show the examples of composition of photoconductive toner to which the present invention can be applied.
Figure 2:
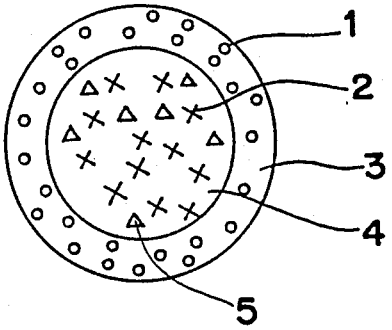
Figure 3:
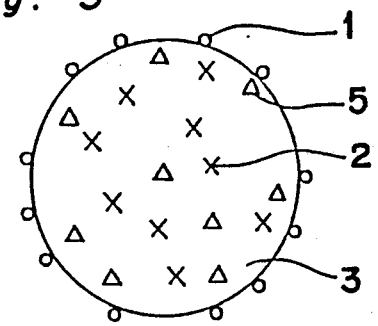

The typical examples of the structure of the photoconductive toner are shown in FIGS. 1-3.

FIG. 1 shows dispersion type photoconductive toner wherein a charge generating substance (1) and a charge-transporting substance (2) are dispersed in a thermoplastic resin (3) (hereinafter referred to as "dispersion-type photoconductive toner"). Like the charge-transporting substance and the charge generating substance, the polymeric-magnetic coordination complex (5) is dispersed in the thermoplastic resin.

FIG. 2 shows a coating-type photoconductive toner wherein the nucleus core material (4) containing the charge-transporting substance (2) is coated with the thermoplastic resin containing the charge generating substance (1) dispersed therein (hereinafter referred to as a "coating-type photoconductive toner"). The polymeric-magnetic coordination complex (5) may be contained in the nucleus core material or the coating layer. Of course, it may be contained in both of the nucleus core material and the coating layer. In FIG. 2, the structure wherein the polymeric-magnetic coordination complex is contained in the nucleus core material is illustrated.

FIG. 3 shows the structure wherein the charge generating substance (1) is fixed on the surface of the thermoplastic resin particle with charge-transporting substance (2) dispersed therein (fixed-type photoconductive toner).

The polymeric-magnetic coordination complex powder may be dispersed in the thermoplastic resin with the charge-transporting substance (2), or fixed on the surface of the resin with the charge generating substance (1). In FIG. 3, the structure wherein the polymeric-magnetic coordination complex powder is dispersed in the thermoplastic resin (3) is indicated.

Figure 4:
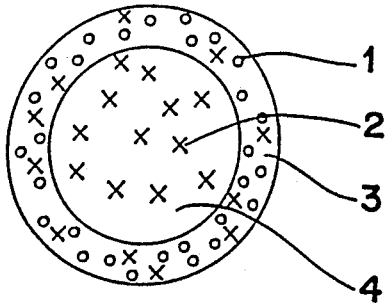
Figure 5:
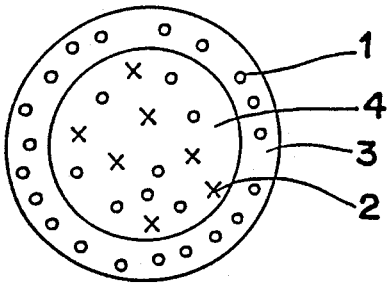
Figure 6:
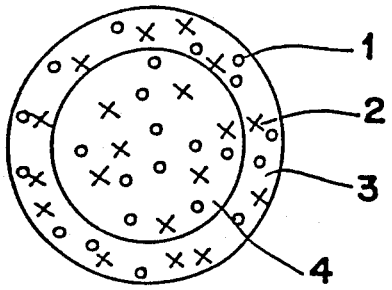
Figure 7:
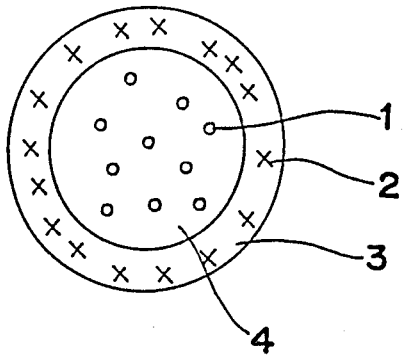
Figure 8:
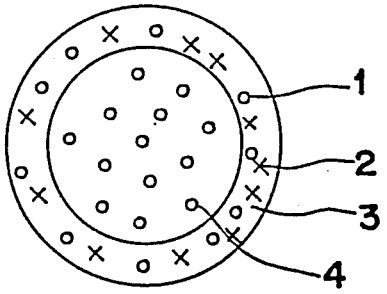
Figure 9:
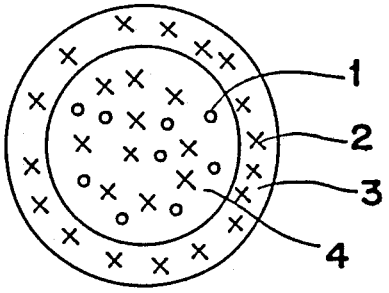
Figure 10:
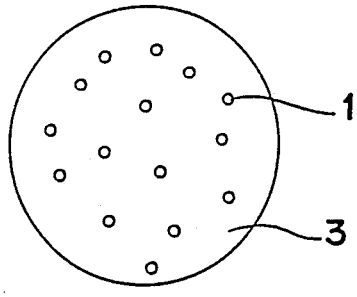
Figure 11:
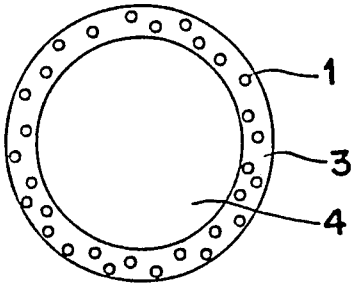
Figure 12:
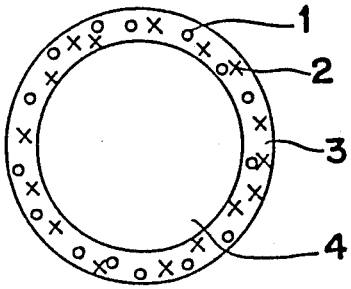

The example of the structure of the photoconductive toner which can contain the polymeric-magnetic coordination complex powder includes the coating-type photoconductive toner (FIG. 2) wherein the charge-transporting substance (2) is contained in the coating layer to enhance the photosensitivity (FIG. 4), a photoconductive toner wherein the nucleus core substance (4) contains the charge-transporting substance (2) and the charge generating substance (1), and the coating layer contains the charge generating substance (1) (FIG. 5), a photoconductive toner wherein both layers of the nucleus core material (4) and the coating layer contain the charge generating substance (1) as well as the charge-transporting substance (2) (FIG. 6), a photoconductive toner wherein the nucleus core substance (4) contains a charge-generating substance (1) and the coating layer contains the charge transporting substance (FIG. 7), a toner wherein the nucleus core material (4) contains the charge generating substance (1) and the coating layer contains the charge generating substance (1) as well as charge-transporting substance (2) (FIG. 8), or the toner wherein the nucleus core material (4) contains the charge-transporting substance (2) and the charge generating substance (1), and the coating layer contains the charge-transporting substance (2) (FIG. 9), the toner wherein the charge generating substance (1) is solely dispersed in the thermoplastic resin (3) (FIG. 10), the toner wherein the nucleus core material (4) contains nothing and the coating layer contains the charge generating substance (1) (FIG. 11), the toner similar to that of FIG. 11 with the exception that it further contains the charge-transporting substance (2) (FIG. 12).

The dispersion type photoconductive toner may be produced by applying the known processes, for example, by dispersing the charge generating substance and the polymeric-magnetic coordination complex particles in the thermoplastic resin solution or a solution of the charge-transporting substance and the thermoplastic resin solution, followed by spray-drying process, or heat kneading process without using solvent. The process may not be particularly limited. The product is prepared in a particle diameter of 1-30 $\mu$m, preferably, 5-25 $\mu$m, more preferably, 8-20 $\mu$m. If it is smaller than 1 $\mu$m, the fluidity after preparation of the toner may be deteriorated and photosensitivity may be remarkably reduced. If it is larger than 30 $\mu$m, the final image, particularly the resolving power may become bad. In this case, the polymeric-magnetic coordination complex powder contained is 0.1-50 wt %, preferably 1-30 wt %. If it is less than 0.1 wt %, marked effect may not be observed. When it is more than 50 wt %, the fixing of the toner may become poor and restraint of the magnet roller may be stronger, resulting in poor developing properties. The charge generating substance contained is 1-90 wt %, preferably, 5-50 wt %. When it is less than 1 wt %, photosensitivity and staining power may be insufficient. When it is more than 90 wt %, the binding properties with the resin may be so poor that granulation may become difficult. When the toner may be multi-layer, the light will not reach to the substratum, resulting in problems such as deficient photosensitivity or increase of residual electric potential. Further, conductive substance may be added to restrain the increase of the residual electric potential.

If a large amount of the conductive substance is added, several problems will be arisen, for example, increase of dark decay and deficient charge.

As the thermoplastic resin, for example, polyethylene resin, acrylic resin, methacrylic resin, polyester resin, polyamide resin, polyethylene, polypropylene, polyvinylidene fluoride, polyvinylidene chloride, polyvinyl chloride, ethylene-vinyl acetate copolymer, styrene-acrylate copolymer, styrene-methacrylate copolymer, styrene-butadiene copolymer, styrene-vinylidene chloride copolymer, styrene-vinyl chloride copolymer, styrene-vinylidene fluoride copolymer, styrene-acrylonitrile copolymer, epoxy resin, modified rosin, polyethylene wax, polycarbonate resin may be used alone or as a mixture thereof.

When the photoconductive toner of the present invention is used especially as a toner for pressure fixing, polyolefin (e.g., low molecular weight polyethylene, low molecular weight polypropylene, polyethylene oxide, polytetrafluoroethylene), epoxy resin, polyester resin (acid value: not more than 10), styrene-butadiene copolymer (monomer ratio: 5-30:95-70), olefin copolymer (ethylene-acrylic acid copolymer, ethylene-acrylate copolymer, ethylene-methacrylic acid copolymer, ethylene-methacrylate copolymer, ethylene-vinyl chloride copolymer, ethylene-vinyl acetate copolymer, ionomer resin), polyvinyl pyrolidone, methyl vinyl ether maleic anhydride copolymer, maleic acid modified phenol resin, phenol modified terpene resin and the like may be used as a thermoplastic resin.

As the charge generating substance, either inorganic or organic substance which can absorb visible light to generate free carrier may be used. For example, inorganic substance such as amorphous selenium, trigonal system selenium, selenium-arsenic alloy, selenium-tellurium alloy, cadmium sulfide, cadmium selenide, mercury sulfide, lead oxide, lead sulfide; organic substance such as azo dye, e.g., monoazo, disazo, trisazo dye, perylene dye, anthraquione dye, carbonium dye, quinoneimine dye, methyn dye, quinoline dye, polycyclic quinone, indigo pigments, phthalocyanine pigment, nitroso-color, nitron dye, benzoquinone and naphthoquinon dye, naphthalimide dye, perinone dye or quinacridone dye may be used.

Of course, various kinds of sensitizing dyes may be used alone or a mixture thereof in the combination of the charge generating substance of the present invention.

The charge-transporting substance includes, for example, hydrazone derivatives, styryl compounds, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, pyrazoline derivatives, oxazolone derivatives, benzothiazole derivatives, benzimidazole derivatives, quinazoline derivatives, benzfuran derivatives, acridine derivatives, phenazine derivatives, aminostilbene derivatives, poly-N-vinylcarbazol, poly-1-vinylpyrene, poly-9-vinylanthracene, 2,4,7-trinitrofluorenone, 2,4,5,7-tetranitrofluorenone, 2,7-dinitrofluorenone. These charge-transporting substances may be used alone or a mixture thereof.

The coating-type photoconductive toner may be obtained by further forming a coating layer on the nucleus core material. A process wherein a coating layer is formed on the nucleus core material by spray-drying process, or a process wherein polymer having multilayer structure is formed using the thermoplastic resin monomer by emulsion polymerization or suspension polymerization and the like may be employed.

The coating layer may be composed of the same ingredients as that of the above thermoplastic resin. The thickness of the coating layer is 0.1–10 μm, desirably 0.1–2 μm. Suitable conditions may be selected depending on the types, amount of the individual compositions, practically, properties, for example, chargeability or photoconductivity as a photoconductive toner, setting density when formed into image.

The polymeric-magnetic coordination complex powder may be incorporated in the coating layer in the amount of 0.1–50 wt %, preferably 1–30 wt % based on the total amount of the coating layer. When it is less than 0.1 wt %, marked effect may not be obtained. When it is more than 30 wt %, photosensitivity may be deteriorated and restraint of magnet roller may be strengthened, resulting in poor development properties. Similarly, the polymeric-magnetic coordination complex powder may be incorporated in the nucleus core particles. But when used in a coating layer, the required amount may be reduced.

The charge-transporting substance may be incorporated in the coating layer in the amount of 0–80 wt %, preferably 0.1–50 wt %, more preferably, 1–30 wt %, based on the total amount of the coating layer. When it is more than 80 wt %, the charge-transporting substance may be sometimes separated out, resulting in difficulties in formation of the coating layer. When the nucleus core substance simultaneously contains the charge-transporting substance, the required amount should be less than the above amount.

By incorporating the charge-transporting substance in the coating layer, migration of the carrier generated by light in the coating layer as well as between the nucleus core substance and the coating layer may be facilitated, resulting in enhancement of photoconductivity.

The charge generating substance may be incorporated in the coating layer in the amount of 3–100 wt %, preferably, 10–80 wt %, more preferably, 20–60 wt % based on the total amount of the coating layer. When it is less than 5 wt % , photosensitivity may be generally deteriorated, sometimes resulting in insufficient setting density of the final image. When the charge generating substance may be also incorporated in the nucleus core particles, the required amount may be smaller than the above amount.

The particle diameter of the nucleus core material is closely related to that of the final photoconductive toner. It affects the final picture quality, particularly, resolving power. It is generally 1–30 μm, desirably 5–20 μm. When it is smaller than 1 μm, the fluidity, photosensitivity and the like after formation of the toner may be deficient, and when larger than 30 μm, the final picture quality, particularly resolving power may be insufficient. The nucleus core substance is desirably globular, but the shape is not particularly limited.

As the nucleus core material, the same material described for the above thermoplastic resin may be used. Alternatively, those obtained by the process, for example, emulsion polymerization or suspension polymerization of the thermoplastic binding resin monomer or prepolymer with a mixture of charge-transporting substance and other additives, or a process which comprises dissolving resin and charge-transporting substance in a solvent and granulating by spray-drying process may be used.

The polymeric-magnetic coordination complex powder contained in the core particles is 0.5–50 wt %, preferably, 1–30 wt %, based on the total amount of the nucleus core particles. When it is less than 0.5 wt %, the marked effect may not be observed and when it is more than 50 wt %, development properties may be deteriorated by the reduction of the photosensitivity or greater restraint of the magnet roller. When the polymeric-magnetic coordination complex powder is also incorporated in the coating layer, the smaller amount may be required compared with the above amount.

When the charge-transporting substance is incorporated in the nucleus core particles, the amount to be added should be such that it never separates out when the nucleus particles are prepared using the substance in a combination with the thermoplastic resin. The amount to be added varies depending on the types of the resin and the charge-transporting substance, or whether it is added alone or in a combination thereof. About 0.1–95 wt %, preferably, 30–80 wt %, more preferably, 40–60 wt %, based on the amount of the resin, may be added. When it is less than 0.1 wt %, transportation ability of the carrier in the nucleus core material may be deficient, and when it is more than 95 wt %, the charge-transporting substance may be generally separated out, resulting in difficulties in granulation.

When the charge-transporting substance is also incorporated in the coating layer, the smaller amount than the above amount may be required.

The charge generating substance contained in the nucleus core particles may be 0.5–40 wt %, preferably, 1–20 wt % based on the total amount of the nucleus core particles. When it is more than 20 wt %, the dispersibility in the binding resin and the fixing ability may be deteriorated. When it is less than 0.5 wt %, the photosensitivity may be deteriorated. Further, the setting density of the final image may sometimes become insufficient. When the charge generating substance is also incorporated in the coating layer, the amount smaller than that described above may be required.

The fixed-type photoconductive toner is different from the coating-type photoconductive toner in that polymeric-magnetic coordination complex powder or charge generating layer is fixed on the surface of the nucleus core particles instead of using thermoplastic resin. To fix these substances, a process wherein they are electrostatically bonded on the nucleus particles and fused by locally applying heat to the nucleus particles, or a process wherein a solvent which can expand or dissolve resin is applied and dried may be employed.

The amount of the polymeric-magnetic coordination complex powder, charge generating substance and charge-transporting substance used may be almost same as that of the case of the coating-type photoconductive toner.

Moreover, various disazo pigment, sensitizing dye or the like may be used alone or as a mixture thereof in a combination with the photoconductive substance indicated in the present invention.

The colorant includes the known pigments or dyes, for example, carbon black, nigrosine dye, aniline blue, chalco oil blue, chrome yellow, ultra-marin blue, DuPont oil red, quinoline yellow, methylene blue chloride, phthalocyanine blue, malachite green oxalate, lamp black, oil black, azo-oil black, rose bengale, or a mixture thereof.

As the sensitizer, electron attractive sensitizer, for example, chloranil, tetracyanoethylene, 2,4,7-trinitro, 9-alorenone, 5,6-dicyanobenzoquinone, tetracyanoquinodimethane, tetrachlorophthalic anhydride, 3,5-dinitrobenzoic acid; methyl violet, rhodamine B, cyanin dye, pyrylium salt, thiapyrylium salt and the like may be used.

To the photoconductive toner of the present invention, known additives may be optionally added in such amount that it does not obstruct the object and effect of the present invention. Further, as such additives, wax and the like may be added to improve fixing ability, or conductive substance such as metallic oxide dust may be added to improve photoconductivity, particularly to reduce residual electric potential. Further, to improve the properties of the toner, a colorant, a charge controller, a fluidizer and the like may be optionally added. Particularly in the case of the coating-type photoconductive toner, wax or a conductive substance such as metallic oxide dust and the like may be added to the nucleus core material to improve fixing ability or conductivity. To the coating layer, a charge controller and a fluidizer may be added to improve chargeability and fluidity.

The photoconductive toner of the present invention may be used for a copying machine of the structure without photosensitive member. Accordingly, simplification of the copying machine, reduction of the production cost may be attained. In addition, the photoconductive toner of the present invention may be used for the conventional copying machines.

EXAMPLE 1

| | |
|---|---|
| styrene-acrylic copolymer resin (SBM 73, produced by Sanyo Kasei Kogyo K.K.) | 100 parts by weight |
| disazo compound (chlorodianblue of the following formula) | 30 parts by weight |

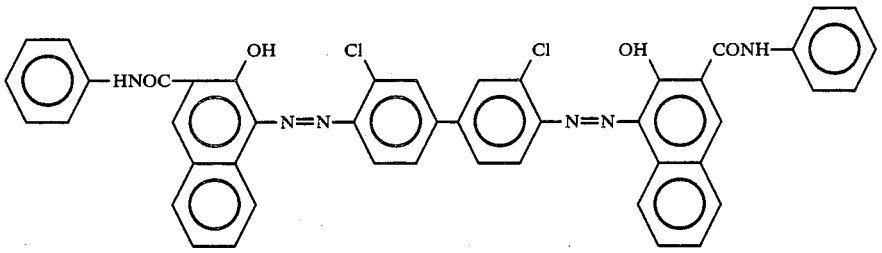

| | |
|---|---|
| p-diethylaminobenzaldehydediphenylhydrazone (DEH of the following formula) | 30 parts by weight |

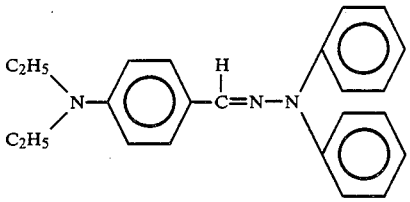

| | |
|---|---|
| Viscol 550P (produced by Sanyo Kasei Kogyo K.K.) | 5 parts by weight |
| polymeric-magnetic coordination complex (PPH-$FeSO_4$) | 10 parts by weight |

The above ingredients were mixed sufficiently in a ball mill, and kneaded over a three-roll heated to 140° C.

The kneaded mixture was left to stand for cooling the same, and then, was coarsely pulverized with the use of a feather mill. The obtained coarse particles were further pulverized under jet stream, followed by being air-classified to obtain photoconductive toner (1) of an average particle diameter of 13 μm.

EXAMPLE 2

(a) preparation of nucleus particles:

| | |
|---|---|
| styrene | 70 parts by weight |
| n-butyl methacrylate | 30 parts by weight |
| 2,2'-azobis(isobutyronitrile) (polymerization initiator) | 2 parts by weight |
| 2-methyl-4-dibenzylamino- | 30 parts by weight |

-continued

| | |
|---|---|
| sodium lauryl sulfate | 0.1 parts by weight |

and the resultant was homomixed at 5,000 rpm at room temperature for 10 minutes. After deaeration and purge with nitrogen, the mixture was heated to 70° C. and polymerized for 6 hours with general stirring. This solution was put into distilled water (2 L) and decanted. This operation was repeated three times. Subsequently, the particles were separated three times. Subsequently, the particles were separated by a centrifuge and dried to give a very small amount of particles of an average particle diameter of 10 μm.

(b) Preparation of photoconductive toner:

| thermoplastic resin | |
|---|---|
| styrene | 70 parts by weight |
| n-butylmethacrylate | 20 parts by weight |
| diethylaminomethacrylate | 10 parts by weight |
| copolymer (a softening point: 132° C., a glass transition temperature: 58° C.) | |

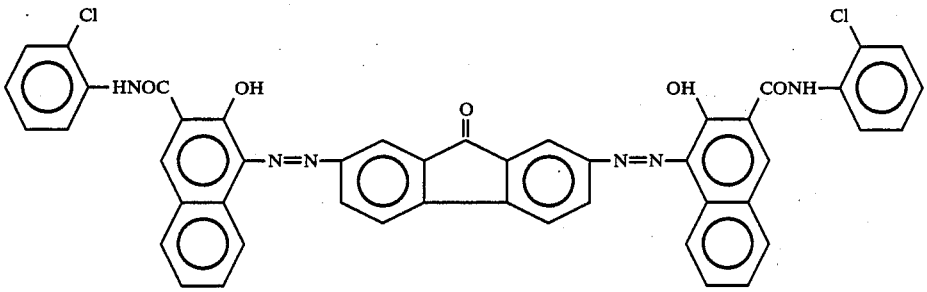

disazo compound of the above formula (2,7-bis[hydroxy-3-2-chlorophenlcarbamoyl) 1-naphthtlazo]-9-fluorenone) 30 parts weight

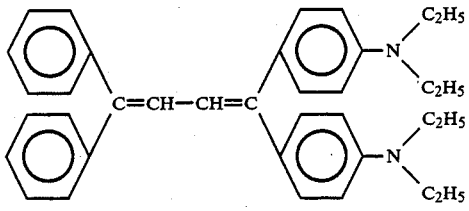

benzaldehydediphenylhydrazone

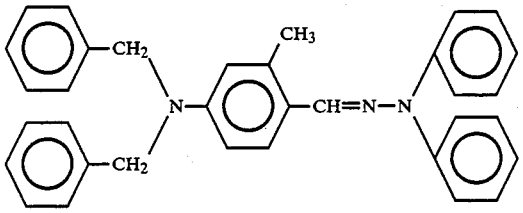

polymeric-magnetic coordination complex: 10 parts by weight PPH-$FeSO_4$

To the homogeneous dispersion of the above composition was added a dispersion medium of the following composition:

| | |
|---|---|
| 0.8 wt % aqueous solution of methyl cellulose | 400 parts by weight |
| 1,1'-diphenyl-4,4'-di(p-diethyl-aminophenyl)butadiene | 10 parts by weight |

The above ingredients were homogeneously dispersed and stirred in toulene by high-shear stirring, then nucleus particles prepared in the preparation of nucleus particles (a) was added thereto and spray-dried to give a top-coating. As a result, photoconductive toner (2) of an average particle diameter of 11 μm with a top-coating of 1.0 μm was obtained.

EXAMPLE 3

(a) preparation of nucleus particles:

| | |
|---|---|
| styrene-acryl copolymer resin (a softening point: 135° C., a glass transition point: 58° C.) | 100 parts by weight |
| N-ethylcarbazole-3-aldehyde-diphenylhydrazone | 30 parts by weight |

-continued

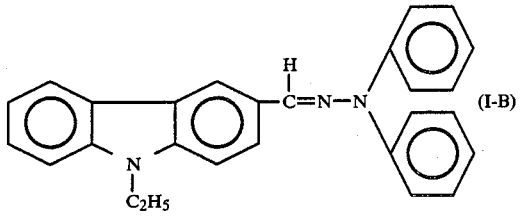

(I-B)

| | |
|---|---|
| Viscol 550p (produced by Sanyo Kasei Kogyo K.K.) | 5 parts by weight |
| polymeric-magnetic coordination complex PPH-$FeSO_4$ | 10 parts by weight |

The above ingredients were mixed sufficiently in a ball mill, and kneaded over a three roll heated to 140° C. The kneaded mixture was left to stand for cooling the same, and then, was coarsely pulverized with the use of a feather mill. The obtained coarse particles were further pulverized under jet stream, followed by being air-classified to obtain nucleus particles of an average particle diameter of 11 μm. (b) Preparation of photoconductive toner The above nucleus particles (100 parts by weight) and 2,5-bis[4-[hydroxy-3-(2-chlorophenylcarbamoyl)-1-naphtylazo]phenyl]1,3,4-oxadiazole of the following chemical structure (5 parts by weight):

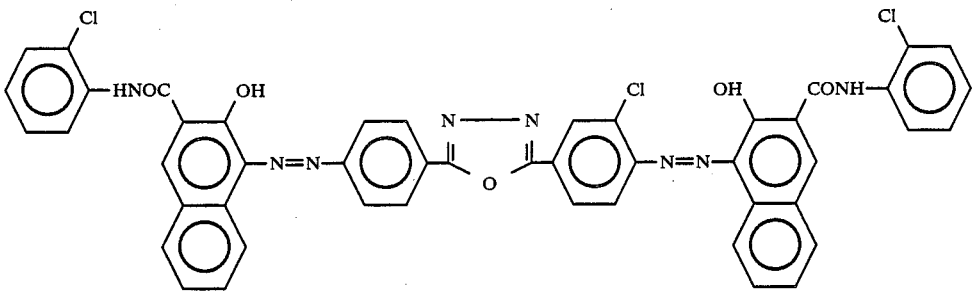

were put in 10 L Henschel mixer and stirred at 1,500 rpm for 2 minutes to uniformly cover the nucleus with the above bisazo compound. Subsequently, the particles were dispersed in air flow heated at 20° C. to heat for about 5 seconds. Thus, only surface of the nucleus body was locally fused and its surface was covered with bisazo compound to give photoconductive toner (3) of an average particle diameter of 13 μm.

REFERENCE EXAMPLE 1

In the same manner as that of the Example 1 with the exception that inorganic magnetic substance EPT-1000 (produced by Toda Kogyo K.K.) (10 parts by weight) was used instead of the polymeric-magnetic coordination complex PPH-$FeSO_4$, photoconductive toner (4) of an average particle diameter of 13 μm was obtained.

EVALUATION

Using the photoconductive toners 1–4 obtained in Examples 1–3 and Reference Example 1, uniform thin layers of the toner were formed on a brass base by magnetic brush development. Subsequently, the toner layer was uniformly charged by corona discharge (+5 KV), then image was exposed to form electrostatic latent image on the toner layer. Plain paper was placed in contact with the image, and corona discharge (−5KV, polarity reverse to the above one) was applied on the surface contacted with paper and the toner of the latent image was transferred to the plain paper. Further, by heat fixing, toners 1, 2 and 3 provided vivid royal purple, purplish red and red images, respectively. Such images were free from fog of toner in the background and inside of the copying machine was not contaminated by dusting of the toner.

On the contrary, although uniform and thin toner layer was formed using the toner 4, poor photosensitivity during exposure of the image resulted in poor density of the image and entirely fogged image.

What is claimed is:

1. A photoconductive toner comprising at least a thermo-plastic resin, a photoconductive material and a polymeric-magnetic coordination complex.

2. A photoconductive toner of claim 1, wherein the photoconductive material comprises a charge transporting material and a charge generating material.

3. A photoconductive toner with a coating layer characterized by that a nucleus core material containing a charge-transporting substance is coated with a thermoplastic resin containing a charge-generating substance dispersed therein, and a polymeric-magnetic coordination complex is contained in the nucleus core material and/or in the coating layer.

4. A photoconductive toner characterized by that a charge generating substance is fixed on the surface of a thermoplastic resin particle with a charge-transporting substance dispersed therein, and that a polymeric- magnetic coordination complex is fixed on the surface of a thermoplastic resin particle and/or contained in the thermoplastic resin.

* * * * *